US006145868A

United States Patent [19]

Schaller et al.

[11] Patent Number: 6,145,868

[45] Date of Patent: Nov. 14, 2000

[54] BINDING SYSTEM FOR AN ARTICLE USED TO GLIDE ON SNOW

[75] Inventors: Hubert Schaller, Rosenheim; Christian Breuer, Botzingen, both of Germany

[73] Assignee: The Burton Corporation, Burlington, Vt.

[21] Appl. No.: 09/003,096

[22] Filed: Jan. 6, 1998

Related U.S. Application Data

[60] Provisional application No. 60/046,688, May 16, 1997.

[51] Int. Cl.[7] ..... A63C 9/99

[52] U.S. Cl. ..... 280/624; 280/14.2; 280/613

[58] Field of Search ..... 280/613, 619, 280/621, 623, 624, 625, 626, 633, 14.2, 607; 36/117.1, 115

[56] References Cited

U.S. PATENT DOCUMENTS

| | | | |
|---|---|---|---|
| 3,061,325 | 10/1962 | Glass . | |
| 3,389,481 | 6/1968 | England . | |
| 3,695,623 | 10/1972 | Covini . | |
| 3,727,932 | 4/1973 | Druss et al. | 280/613 |
| 3,772,802 | 11/1973 | Smolka et al. | 280/613 |
| 3,785,668 | 1/1974 | Marker . | |
| 3,899,190 | 8/1975 | Schweizer et al. . | |
| 3,925,911 | 12/1975 | Erlebach . | |
| 3,931,980 | 1/1976 | Marker . | |
| 3,936,062 | 2/1976 | Schweizer . | |
| 3,955,825 | 5/1976 | Kubelka et al. . | |
| 3,992,037 | 11/1976 | Fréchin . | |
| 4,036,510 | 7/1977 | D'Alessio et al. . | |

(List continued on next page.)

FOREIGN PATENT DOCUMENTS

| | | | |
|---|---|---|---|
| 0 719 505 A2 | 7/1996 | European Pat. Off. . | |
| 2705248A1 | 11/1994 | France . | |
| 25 56 817 A1 | 6/1976 | Germany . | |
| 29 27 059 C2 | 1/1980 | Germany . | |
| 44 16 531 A1 | 11/1995 | Germany . | |
| 3019932 | 10/1995 | Japan . | |
| 7-303728 | 11/1995 | Japan . | |
| 8-57108 | 3/1996 | Japan . | |
| WO 8606290 | 1/1986 | WIPO | 280/613 |
| WO 97/22390 | 6/1997 | WIPO . | |

OTHER PUBLICATIONS

Partial English Translation of Japanese Patent Laying–Open No. 7–303728.

*Primary Examiner*—J. J. Swann
*Assistant Examiner*—James S. McClellan
*Attorney, Agent, or Firm*—Wolf, Greenfield & Sacks, P.C.

[57] ABSTRACT

A system is provided for mounting a boot to an article for gliding, for example a snowboard. The system includes a boot having a binding engagement assembly with at least one aperture, and a locking component supported by a binding. The aperture and the locking component are disposed at an angle relative to each other, with the angle being variable so as to adjust the size of the aperture relative to the locking component. In a first, non-secured position, the angle between the locking component and the aperture is such that the size of the aperture relative to the locking component is sufficient to allow the locking component to be slidably received within the aperture. In a second, engaged position the angle between the locking component and the aperture is such that the size of the aperture relative to the locking component produces a fit therebetween sufficient to secure the locking component to the binding engagement assembly. During riding, the angle between the aperture and the locking component may vary without adversely affecting the security of the binding. The boot may be disengaged from the binding by changing the angle between the aperture and the locking component until the size of the aperture relative to the locking component is sufficient so as to allow the locking component to be withdrawn from the binding engagement assembly to release the boot. The system may further include a second locking component supported by the binding for securing a second engagement member supported by the boot. The first and second locking components may be utilized separately, or together to releasably secure the boot to the binding.

40 Claims, 12 Drawing Sheets

U.S. PATENT DOCUMENTS

| | | | |
|---|---|---|---|
| 4,098,010 | 7/1978 | Rothmayer | 280/613 |
| 4,139,211 | 2/1979 | Salomon . | |
| 4,185,851 | 1/1980 | Salomon . | |
| 4,196,920 | 4/1980 | Salomon . | |
| 4,278,269 | 7/1981 | Beyl . | |
| 4,316,618 | 2/1982 | Sampson . | |
| 4,353,574 | 10/1982 | Faulin . | |
| 4,392,666 | 7/1983 | Ramer . | |
| 4,403,789 | 9/1983 | Hickey . | |
| 4,505,493 | 3/1985 | Gustavsson . | |
| 4,640,026 | 2/1987 | Kirsch . | |
| 4,728,115 | 3/1988 | Pozzobon et al. . | |
| 4,741,550 | 5/1988 | Dennis . | |
| 4,846,492 | 7/1989 | Bataille . | |
| 4,901,454 | 2/1990 | Walkhoff . | |
| 4,937,955 | 7/1990 | Bonaventure | 280/613 |
| 4,959,914 | 10/1990 | Hilgarth . | |
| 4,973,073 | 11/1990 | Raines et al. . | |
| 4,982,515 | 1/1991 | Sartor . | |
| 5,007,656 | 4/1991 | Girault et al. . | |
| 5,020,823 | 6/1991 | Bogner . | |
| 5,044,654 | 9/1991 | Meyer . | |
| 5,071,154 | 12/1991 | Szasz et al. . | |
| 5,116,074 | 5/1992 | Pevre . | |
| 5,293,702 | 3/1994 | Miyoshi et al. . | |
| 5,299,823 | 4/1994 | Glaser . | |
| 5,338,053 | 8/1994 | Hauglin . | |
| 5,356,170 | 10/1994 | Carpenter et al. | 280/618 |
| 5,474,322 | 12/1995 | Perkins et al. . | |
| 5,505,477 | 4/1996 | Turner et al. . | |
| 5,505,478 | 4/1996 | Napoliello . | |
| 5,520,405 | 5/1996 | Bourke . | |
| 5,544,909 | 8/1996 | Laughlin et al. | 280/617 |
| 5,577,757 | 11/1996 | Riepl et al. . | |
| 5,595,396 | 1/1997 | Bourdeau . | |
| 5,647,148 | 7/1997 | Meiselman . | |
| 5,669,630 | 9/1997 | Perkins et al. | 280/613 |
| 5,697,631 | 12/1997 | Ratzek et al. . | |
| 5,913,530 | 6/1999 | Berger et al. | 280/14.2 |

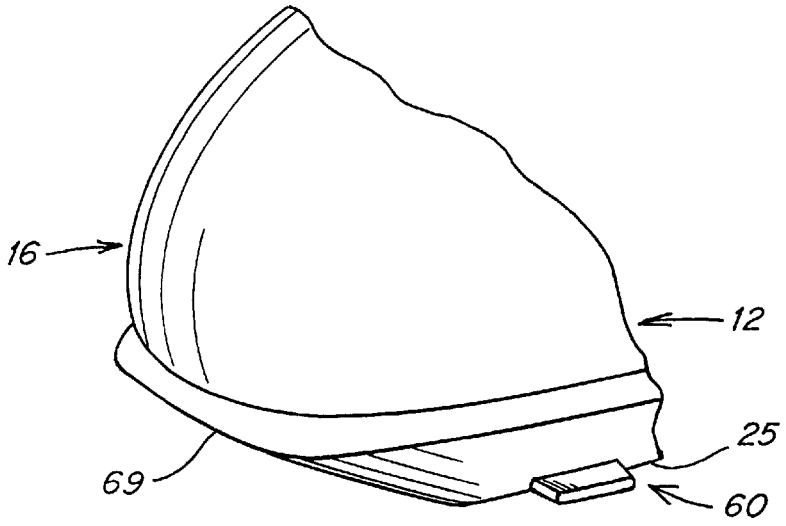
Fig. 13
Fig. 14
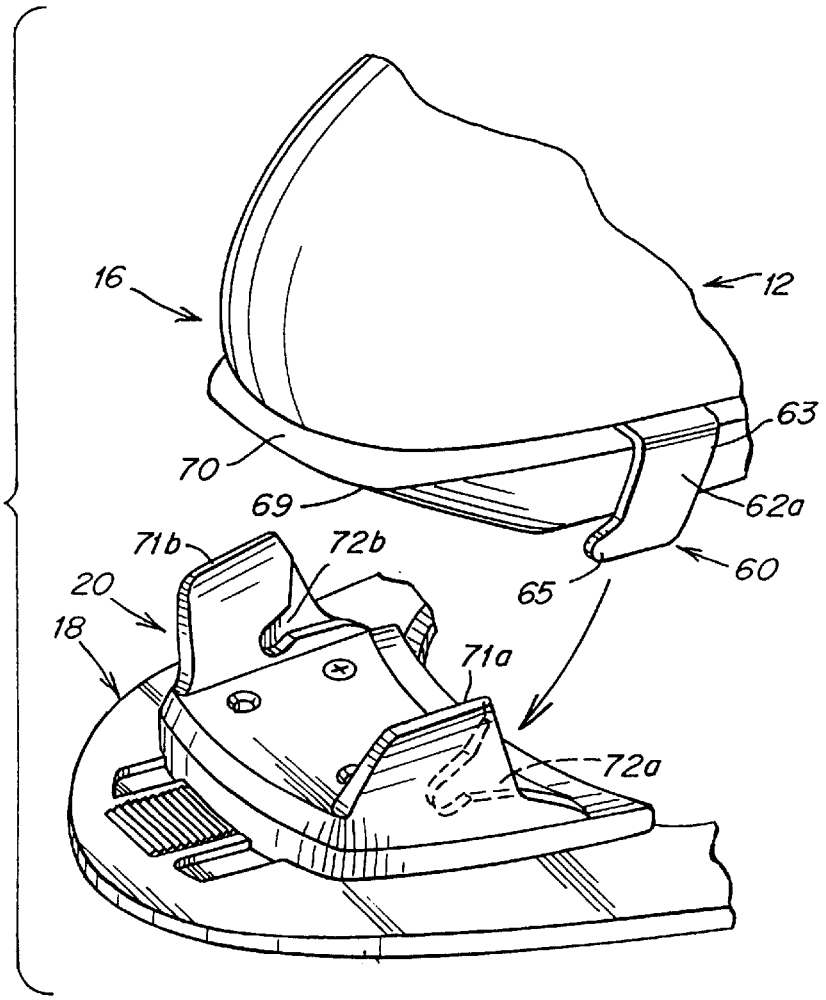

BINDING SYSTEM FOR AN ARTICLE USED TO GLIDE ON SNOW

1. RELATED APPLICATIONS

This application claims priority under 35 USC § 119 (e) to commonly-owned, co-pending U.S. provisional patent application Ser. No. 60/046,688 entitled "Binding System For An Article Used to Glide on Snow", filed May 16, 1997 by Schaller et al., which is incorporated herein by reference in its entirety.

2. TECHNICAL FIELD

The present application relates to a binding system for an article used to glide on snow, such as a snowboard.

3. BACKGROUND OF RELATED ART

A variety of articles are known to traverse a mountain by gliding on snow. Such articles include, but are not limited to, skis, snow skates and snowboards. In the sport of snowboarding, several different types of bindings are utilized to secure a rider's boot, and hence foot, to the snowboard. A soft boot binding typically includes a plate which accepts a soft snowboard boot and two or three incrementally tightenable straps that extend from one side of the plate, over the vamp of the boot, to the other side of the plate, securing the boot to the board. A representative soft boot binding is described in U.S. Pat. No. 5,356,170, which is assigned to the Burton Corporation. A plate binding having adjustable bails is traditionally used with a hard shell snowboard boot, with one bail securing the toe portion of the boot and the other bail securing the heel portion. A representative hard-shell boot binding is described in U.S. Pat. No. 5,544,909, which is also assigned to the Burton Corporation.

Various modifications to soft and hard shell boot bindings have been proposed. In German Patent No. 0 680 775 a binding is described including a hard shell boot having a spring-mounted pin projecting from both sides of the heel which is received within corresponding side pieces of the binding. A cable runs up the back of the boot and is attached to the pin such that pulling on the cable pushes the spring-mounted pin in, thereby releasing the pin from the side pieces.

While prior art snowboard bindings have proven to be effective, there is continued development in the field to produce a varied assortment of bindings which will provide the rider with performance, comfort and convenience.

SUMMARY

In accordance with the present invention a system is provided for mounting a boot to an article for gliding, for example a snowboard. The system includes a boot having a binding engagement assembly with at least one aperture, and a locking component supported by a binding. The aperture and the locking component are disposed at an angle relative to each other, with the angle being variable so as to adjust the orientation of the aperture relative to the locking component. In a first, non-secured position, the angle between the locking component and the aperture is such that the orientation of the aperture relative to the locking component allows the locking component to be slidably received within the aperture. In a second, engaged position the angle between the locking component and the aperture is such that the orientation of the aperture relative to the locking component produces a fit therebetween sufficient to secure the locking component to the binding engagement assembly. By varying the orientation of the aperture relative to the locking component the relative size of the aperture to the component changes. During riding, the angle between the aperture and the locking component may vary without adversely affecting the security of the binding. For example, if the boot moves away from the board, such as when riding over bumps, the angle between the aperture and the locking component may change, thereby changing the orientation of the aperture relative to the locking component in order to further secure the boot to the binding. The boot may be disengaged from the binding by changing the angle between the aperture and the locking component until the orientation of the aperture relative to the locking component allows the locking component to be withdrawn from the binding engagement assembly to release the boot. The system may further include a second locking component supported by the binding for securing a second engagement assembly supported by the boot. The first and second locking components may be utilized separately, or together to releasably secure the boot to the binding.

In one embodiment, the locking component is provided in a binding mounted to an article for gliding on snow, and the binding engagement assembly is provided in a boot. The locking component includes at least one substantially upstanding post, while the binding engagement assembly includes at least one plate member having an aperture sized to receive the corresponding post. The plate member is supported by an axle, with a first end of the axle extending through an opening in the plate member. The opening in the plate member is sized larger than first end of the axle to allow some play, or slop, between the plate member and engagement of the axle. In this manner, the plate member is allowed an amount of initial movement prior to engaging the axle. To disengage the boot, the user pulls on a handle attached to a cable which is connected to a release element. The release element is connected at one end to the axle such that rotation of the release element causes corresponding rotation of axle. Rotation of the axle, in turn, produces movement of the corresponding plate member, once the axle has sufficiently moved within the opening of the plate member so that the slop is overcome, at which point the axle engages the plate member and causes corresponding movement thereof. The plate member moves until the orientation of the aperture relative to the post is sufficient to allow the post to be withdrawn from the aperture.

In another embodiment, the plate member extends in a downward direction from one end of a corresponding axle, so as to be disposed at a pre-selected angle relative to the axle. Extending substantially level from a second end of each axle is a lever arm. The lever arm is engaged at one end by a biasing spring which applies a force on the lever arm sufficient to maintain the relative angle between the plate member and corresponding aperture in the second position. To disengage the boot, the user pulls on a handle attached to a cable which is connected to a release lever. The release lever is operatively connected to the lever arm, such that pulling on the cable causes movement of the lever arm. Movement of the lever arm causes the axle to rotate, which in turn produces movement of the corresponding plate member, until the orientation of the aperture relative to the post is sufficient to allow the post to be withdrawn from the plate member.

In another embodiment, the locking component includes at least one post and the binding engagement assembly includes at least one pre-formed or bent plate member extending from a unitary lever at a pre-selected angle. The lever and plate member may be formed of a plurality of elements stacked one on top of the other, provided that the lever and plate members are resilient so as to temporarily straighten when acted on and thereafter may return to their pre-formed or bent configuration. To disengage the boot, the user pulls on a handle attached to a cable which is connected to an engagement lever. The engagement lever is disposed below the plate member and is pivotally connected such that actuation of the cable causes the engagement lever to pivot, contact the plate member and force the plate member in an upward direction until the orientation of the aperture relative to the post is sufficient to allow the post to be withdrawn from the plate member.

It is therefore an object of the invention to provide a system for releasably securing a boot to an article for gliding on snow which includes a binding engagement assembly supported by the boot and a locking component supported by a binding, the engagement assembly and the locking component co-operating to secure the boot to the binding.

It is another object of the invention to provide a system for releasably securing a boot to an article for gliding on snow which is easy to use.

BRIEF DESCRIPTION OF THE DRAWINGS

Various embodiments are described herein with reference to the drawings, wherein:

FIG. 13 is a partial perspective view of a one embodiment of a second binding engagement assembly of the system of FIG. 1;

FIG. 14 is a partial perspective view of a second embodiment of a second binding engagement assembly and second locking component of the system of FIG. 1;

DETAILED DESCRIPTION OF THE ILLUSTRATIVE EMBODIMENTS

Figure 1:
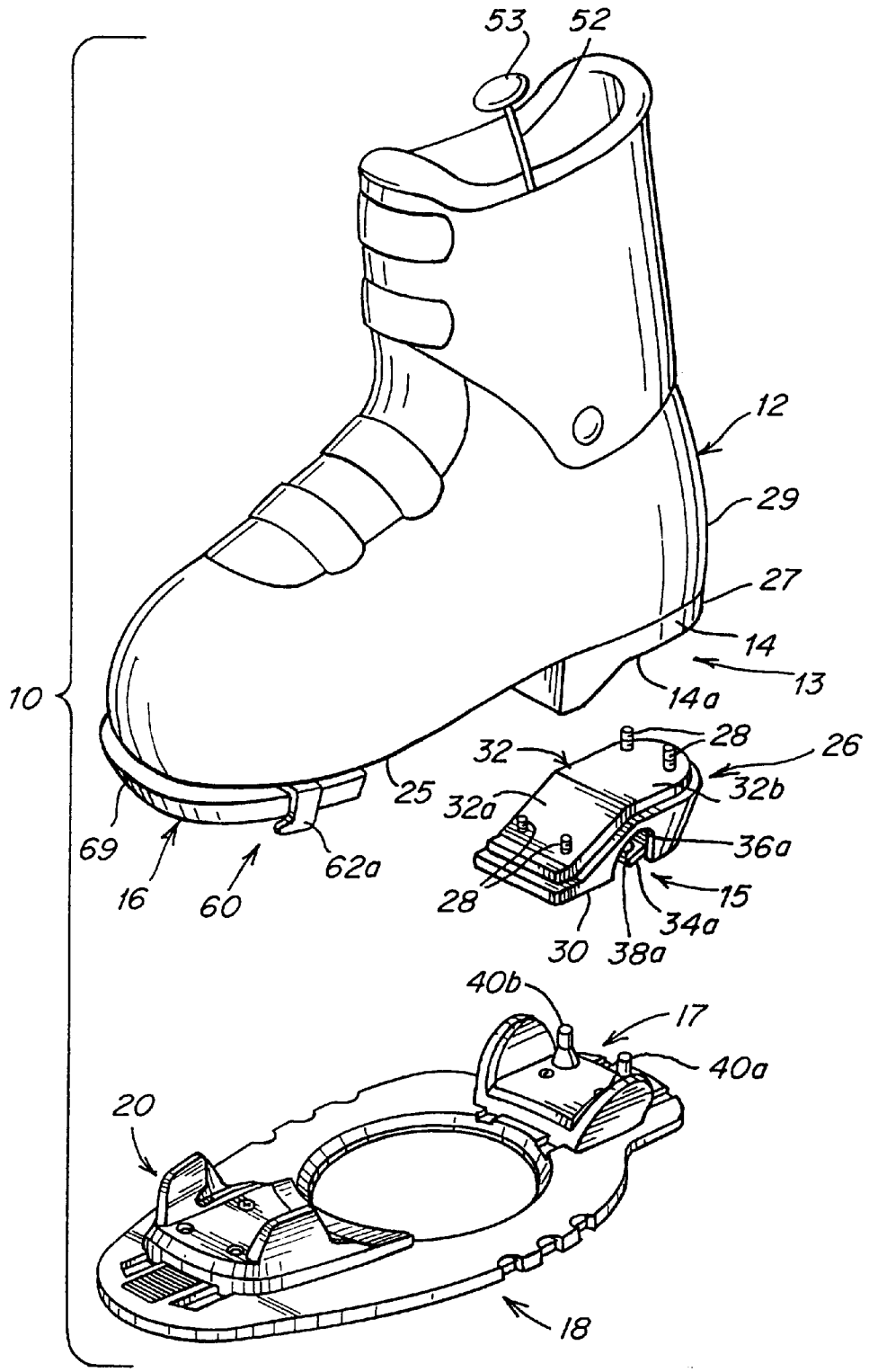
FIG. 1 is an exploded view of a binding system according to the present invention.

A system 10 for securing a boot to a binding is illustrated in FIG. 1, and includes a boot 12 having a binding engagement assembly 15 for connection with a co-operating locking component 17 supported by binding 18. The boot 12 may be a hard shell snowboarding boot having a heel portion 13 and a toe portion 16, although system 10 may be utilized with soft snowboard boots and may also be utilized with any other type of boot for use in any number of sports. Boot 12 is preferably configured and dimensioned to be supported by and secured to binding 18, which may be mounted by fasteners to a snowboard through a hold down disc or integral baseplate, as is known in the art. Alternatively, other types of bases may be utilized for supporting boot 12, for example the snowboard may itself be utilized as the base. Binding 18 may further include a second cooperating locking component 20 supported by binding 18 for engagement with a second binding engagement assembly supported by boot 12, as described in greater detail hereinbelow.

Binding engagement assembly 15 preferably co-operates with locking component 17 in order to secure boot 12 to binding 18 and may be disposed at heel portion 13, or may alternatively, be disposed anywhere along boot 12. The binding engagement assembly 15 may be at least partially disposed within a unitary heel member 14 formed as part of boot 12 or, as shown in FIG. 1, may be at least partially disposed within a housing 26 mounted to heel member 14, with one or both of the housing 26 and the heel member 14 being removably secured to the heel section of the boot by a plurality of fasteners 28, for example screws. Housing 26 may be configured and dimensioned to fit a wide variety of boots and may include a substantially flat lower surface 30 for contact with binding 18 and a contoured upper surface 32 for engagement with heel member 14. Lower surface 30 may include treads for providing traction to the bottom of the boot and the contoured upper surface 32 may preferably include an inclined, or ramp portion 32*a* and a flat or horizontal portion 32*b* for engaging a lower surface 14*a* of heel member 14 having a contour corresponding to the upper surface 32.

Figure 16:
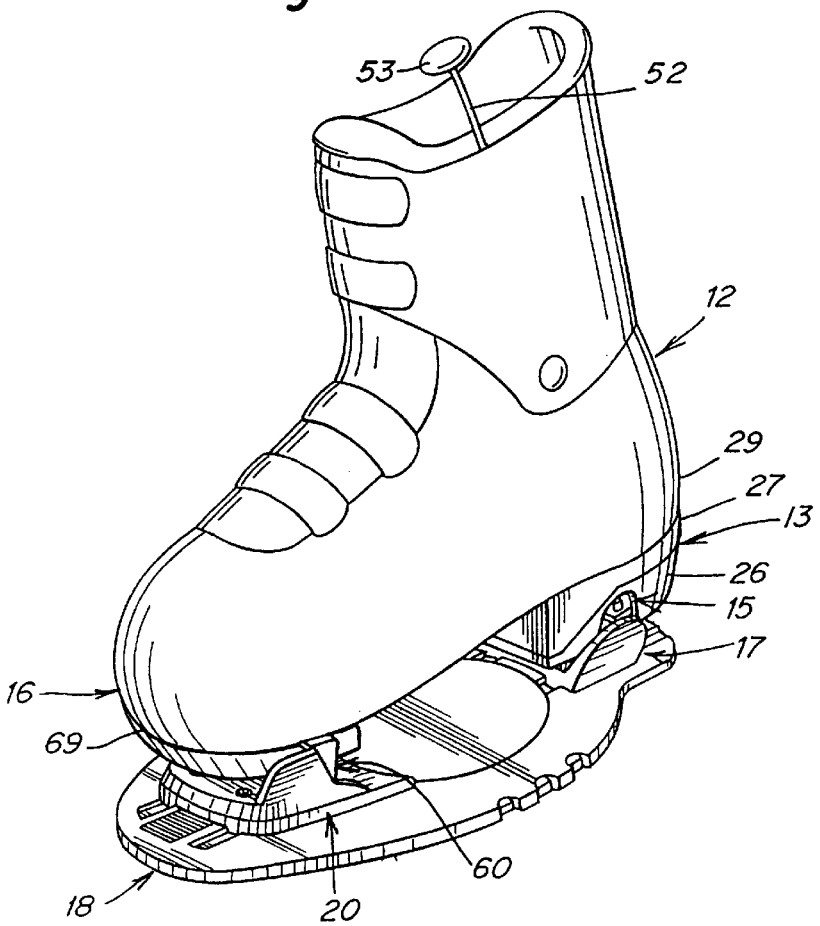
FIG. 16 is a perspective view of the system of FIG. 1 including a first and second binding engagement assembly in an engaged position.
Figure 18:
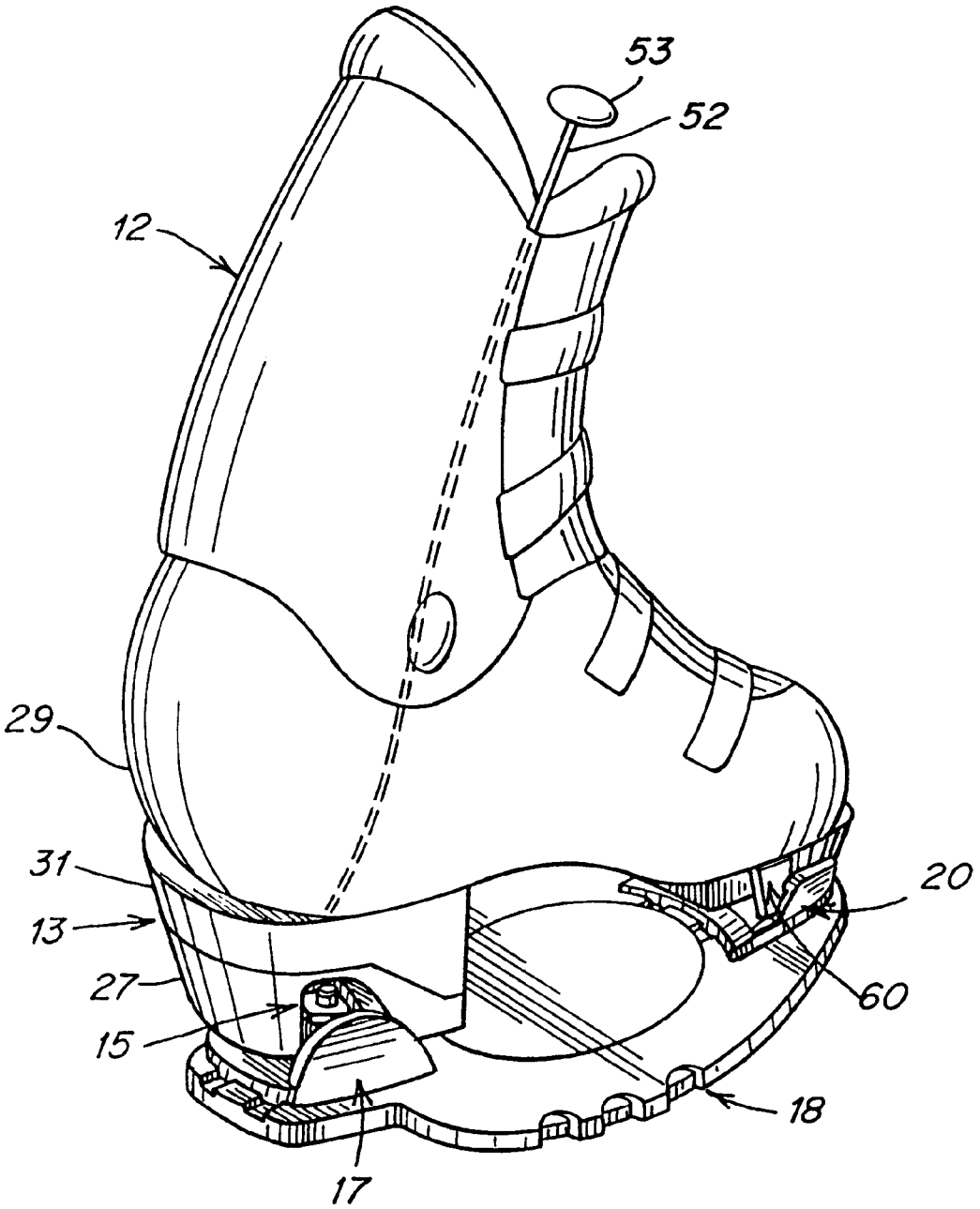
FIG. 18 is a rear perspective view of the system of FIG. 1, including a rear lip.

Heel member 14 and housing 26 may be mounted to the sole 25 of boot 12 so that a rear portion 27 of the heel member and the housing is in a retracted position and does not extend beyond the back 29 of boot 12 (FIG. 16). Mounting the heel member and housing so that they do not extend beyond the back of the boot decreases the overall length of the boot thereby also reducing the chance of heel edge drag of the boot during use, which increases as the overall length of the boot increases. As shown in FIG. 16, the heel member and housing may preferably be mounted in the retracted position so that they are substantially flush with the back of the boot. Alternatively, the heel member and/or housing may be mounted further back on the boot, so that the rear portion 27 of the heel member and the housing extends beyond the back 29 of boot 12, thereby forming a rear lip 31 (FIG. 18). Lip 31 may be utilized as an engagement member with a conventional bail, either alone, or in combination with binding engagement assembly 15. The sole 25 is preferably provided with two sets of mounting holes (not shown) which are engaged by fasteners 28, so that the heel member and housing may be movable between the retracted position and the extended position which forms lip 31 so as to provide the user with the ability to use boot 12 with or without conventional bails.

Binding engagement assembly 15 may be at least partially disposed within housing 26 in order to help protect the engagement assembly from the environment which may include extreme weather conditions and/or rough terrain. Binding engagement assembly 15 may include a pair of plate members 34*a*, 34*b*, extending from within housing 26 into corresponding recesses 36*a*, 36*b*, formed on opposite sides of the housing. Recesses 36*a*, 36*b* provide access to plate members 34*a*, 34*b* for engagement with locking component 17, while also preventing the accumulation of snow around the plate members by allowing snow to escape so that it does not get trapped within the housing and pack around the plate members.

Figure 3A:
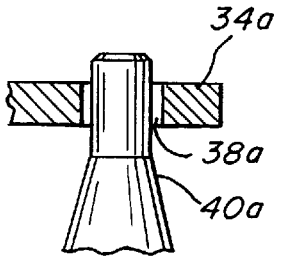
FIG. 3*a* is side view in partial cross section of a plate member and post of the system of FIG. 1 in position for release.
Figure 3B:
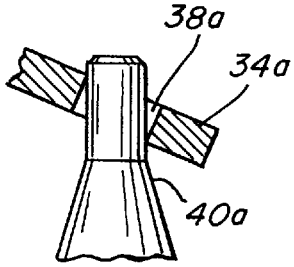
FIG. 3*b* is side view in partial cross section of a plate member and post of the system of FIG. 1 in an engaged position during use.

In the present embodiment, plate members 34*a, b* preferably extend from housing 26 at a preselected angle, as described in greater detail below. Plate members 34*a*, 34*b* each further include an aperture 38*a*, 38*b*, disposed therethrough, the angle of the apertures corresponding to the angle of the plate members in the present embodiment. The relative angle between the apertures and posts 40*a*, 40*b* supported by binding 18 is variable by movement of plate members 34*a*, 34*b* so as to adjust the orientation of the apertures relative to the posts. In a first, non-secured position, the angle between the posts 40*a*, 40*b* and the corresponding apertures 38*a*, 38*b*, is such that the orientation of the apertures relative to the posts is sufficient to allow the posts to be slidably received within the apertures. In a second, engaged position the posts 40*a*, 40*b* are seated within apertures 38*a*, 38*b*, respectively, and the angle between the posts and the apertures is such that the orientation of the apertures relative to the posts produces a clamping force therebetween sufficient to secure the posts to the plate members. By varying the orientation of the aperture relative to the locking component the relative size of the aperture to the component changes. When in the second position, a portion of the plate members surrounding the angled aperture contacts posts 40*a*, 40*b* thereby creating the interference-type fit between the plate members and the corresponding posts (FIG. 3*b*) which functions similar to a friction brake. During riding, the angle between the aperture and the posts may vary without adversely affecting the security of the binding. For example, if the boot moves away from the board, such as when riding over bumps, the angle between the aperture and the posts may change, thereby changing the orientation of the apertures relative to the posts which increases the binding force securing the boot.

Although the angle of the aperture is adjusted in the illustrated embodiment by movement of the plate member, it should be understood that the apertures may be bored at an angle without angling the plate members, likewise the posts may be angled, and that any combination of angles and movement may be utilized in order to adjust the relative angle between the engagement assembly and locking component. In addition, the relative angle of the apertures, as well as the outer diameter of the apertures and posts may vary, but should be selected to ensure that the apertures are able to fit over the corresponding posts in the first position, while frictionally engaging the posts in the second position. In the present embodiment, apertures 38*a, b* are each additionally approximately 0.3 mm larger than the post which they engage, with the posts each having a diameter of approximately 8 mm and a circumference of approximately 25 mm. The angle of the plate members, and hence apertures, is pre-selected in the first position and is preferably in the range of approximately 3 to 30 degrees, and most preferably from 5 to 15 degrees, as measured from a horizontal plane defined by the sole 25 of the boot. In the present embodiment, the pre-selected angle is approximately 6 degrees as described below with respect to the various embodiments, although the angle may be readily varied, as will be apparent to one of skill in the art.

Figure 4A:
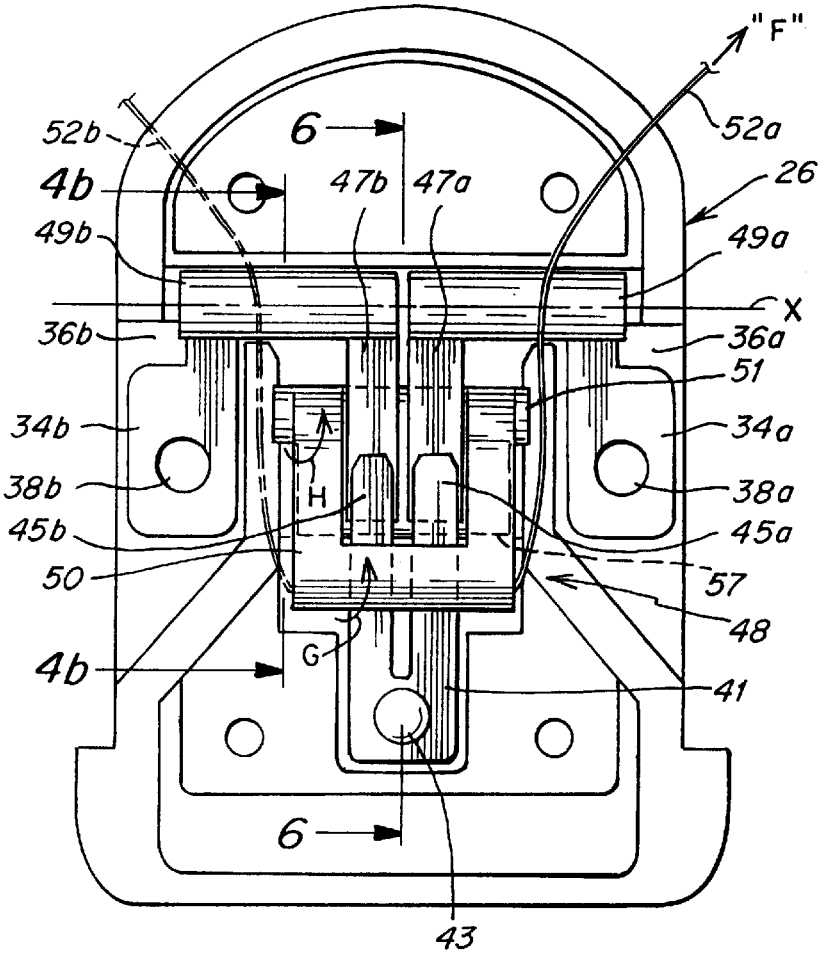
FIG. 4*a* is a schematic of one embodiment of a binding engagement assembly of the system of FIG. 1.

In the embodiment illustrated in FIG. 4*a*, plate members 34*a, b* extend from one end of a corresponding axle 49*a, b* disposed within housing 26. Extending from a second end of each axle 49*a, b* is a lever arm 47*a, b*, the lever arms preferably being spaced parallel to the plate members 34*a, b*, and extending from axles 49*a, b* such that the lever arms are substantially level. Each plate member 34*a, b* may extend in a downward direction from its corresponding axle, so as to be disposed at the pre-selected angle relative to lever arms 47*a, b* in the first position. Each axle 49*a, b* rotates about an axis "x", the plate members and corresponding lever arms each pivoting as an independent pair, in response to rotation of their corresponding axle. Alternatively, a single axle may be utilized with the plate members and corresponding lever arms being a unitary member.

Lever arms 47*a, b* may be engaged by a biasing spring at a second end, for example by a leaf spring 41, the spring applying a force on the lever arms which is sufficient to maintain the plate members and corresponding apertures in the second position during use so as to provide the aforementioned frictional engagement. As shown in FIG. 4*a*, leaf spring 41 may include a first end secured within housing 26 by a fastener 43 and may also include a pair of arms 45*a, b* extending therefrom, each arm configured and dimensioned to engage corresponding lever arms 47*a, b*, with the spring arms being approximately 25 mm long in the present embodiment. Leaf spring 41 may be a pair of springs stacked one on top of the other, so as to maintain the desired force with reduced stress, the springs being made of metal and being approximately 1 mm thick. The leaf springs may alternatively be formed of any suitable material and may be a variety of thicknesses, with the number of plates contributing to the desired thickness for the individual plates, provided that the leaf springs are configured and dimensioned to create a biasing force sufficient to retain the plate members in a sufficient angled configuration relative to the corresponding post.

Figure 7:
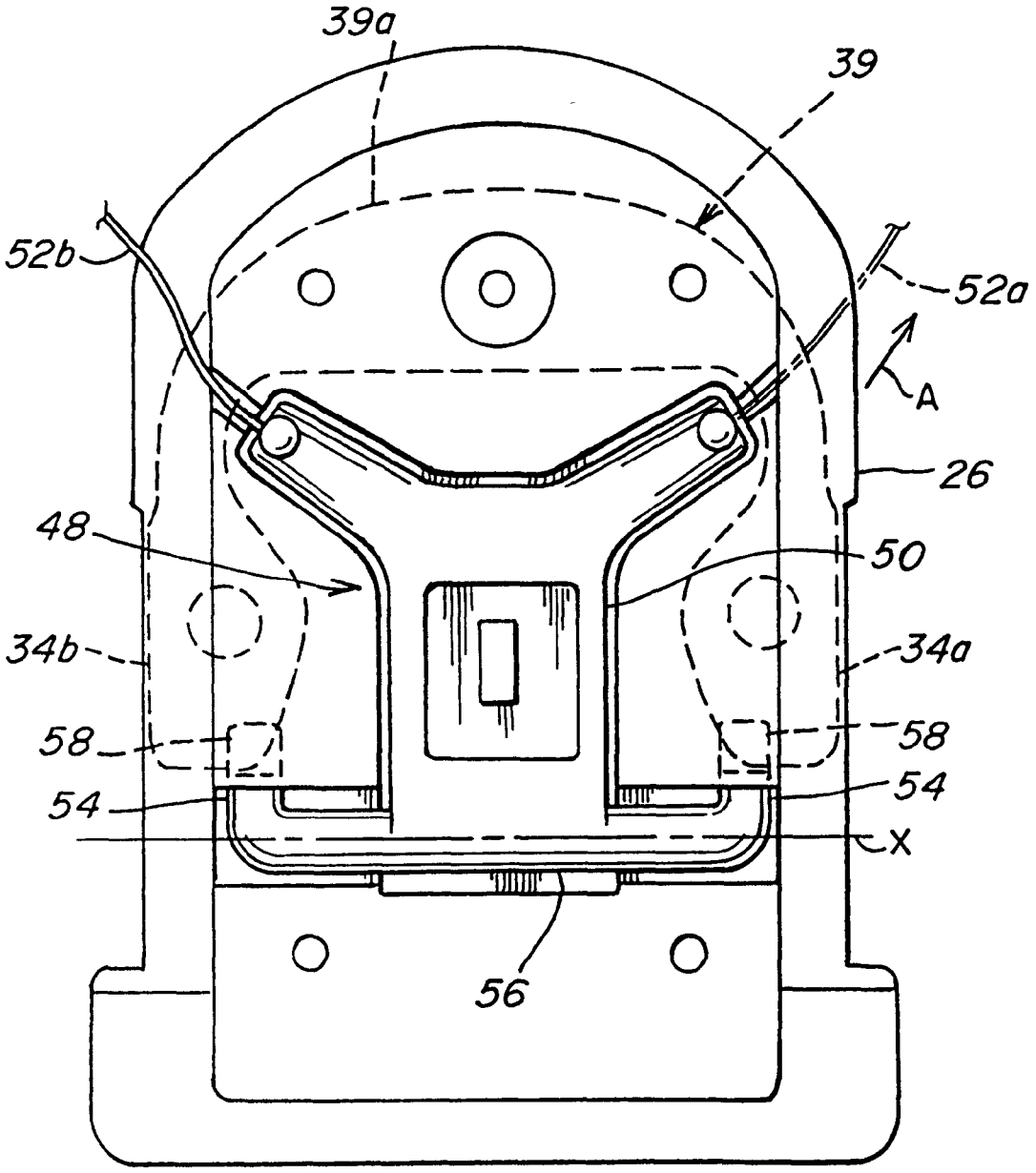
FIG. 7 is a schematic of a second embodiment of a binding engagement assembly of the system of FIG. 1.

As shown in the embodiment of FIG. 7, angled plate members 34*a*, 34*b* may also be formed as part of a unitary lever 39, with the plate members being pre-formed or bent at the pre-selected angle relative to the body 39*a* of lever 39. The lever 39 may have a generally "U" shaped configuration and may be formed of a plurality of elements stacked one on top of the other, for example four steel or other metal members each approximately 0.8 mm thick. The members are preferably resilient so as to temporarily straighten when acted on by the lever, and may thereafter return to their pre-formed, bent configuration. Lever 39 may alternately be formed of a single piece of material for example, a piece approximately 3 mm thick. Utilizing multiple members reduces the stress in each plate and also provides redundancy to the system, so that if one plate member becomes worn over time the other plate members should still hold the boot in place. When utilizing multiple members, the configuration of the multiple plates must still be able to apply a clamping force sufficient to secure the boot to the binding. The plate members may alternatively be formed as separate, non-unitary members, and any material capable of repetitive use without substantial wear or permanent deformation may be utilized, as is known to those of skill in the art.

Figure 10:
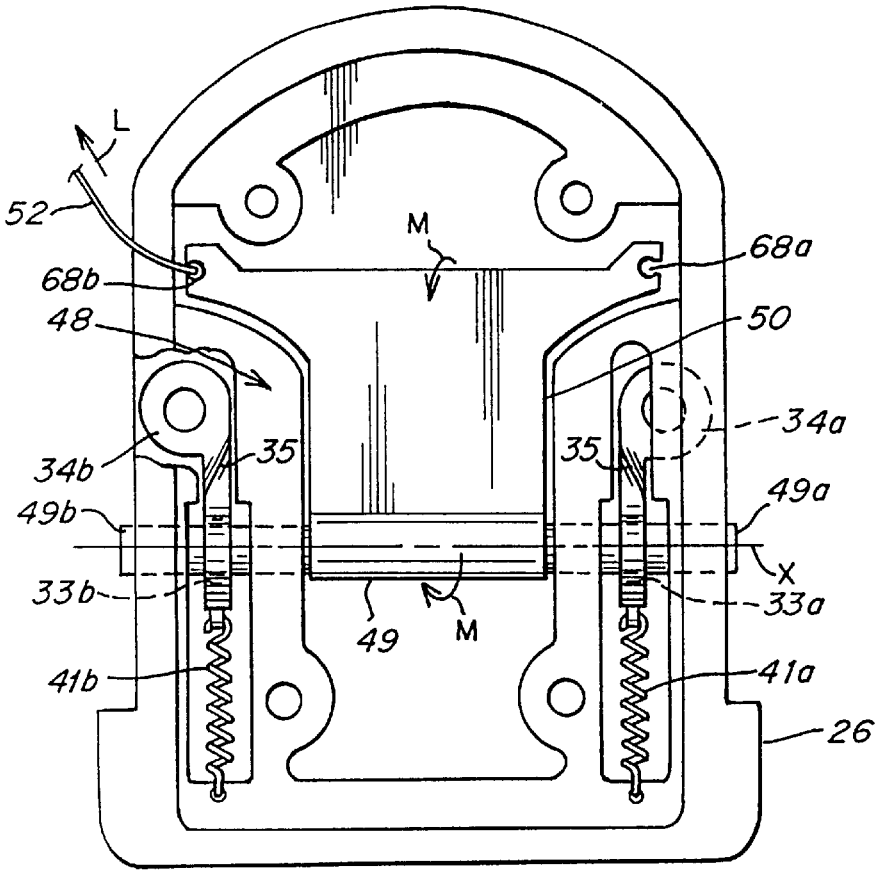
FIG. 10 is a schematic of a third embodiment of a binding engagement assembly of the system of FIG. 1.
Figure 11:
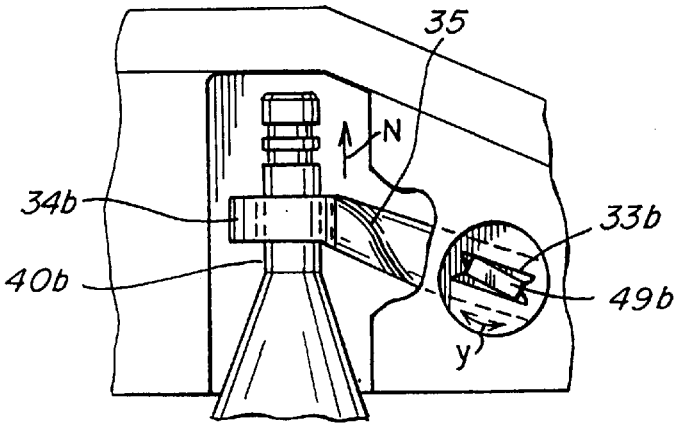
FIG. 11 is a left side view of the binding engagement assembly of FIG. 10.
Figure 12A:
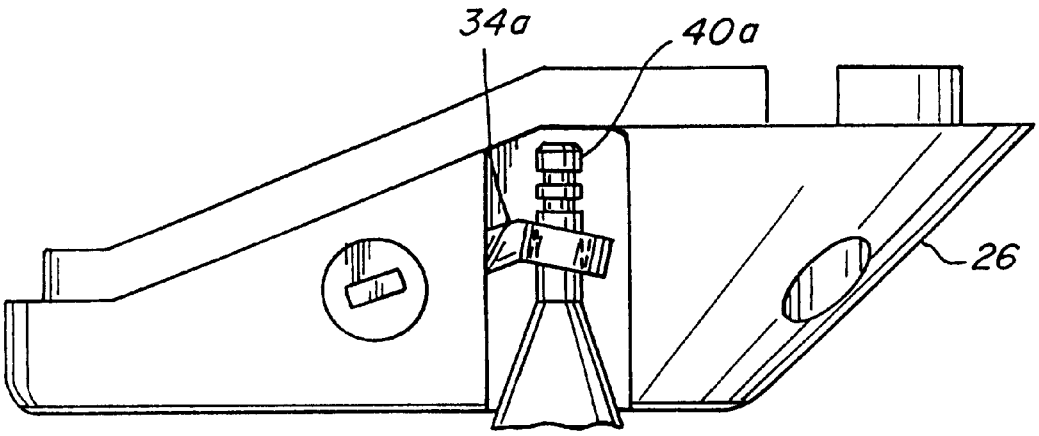
FIG. 12*a* is a right side view of the binding engagement assembly of FIG. 10, engaged with a corresponding post.
Figure 12B:
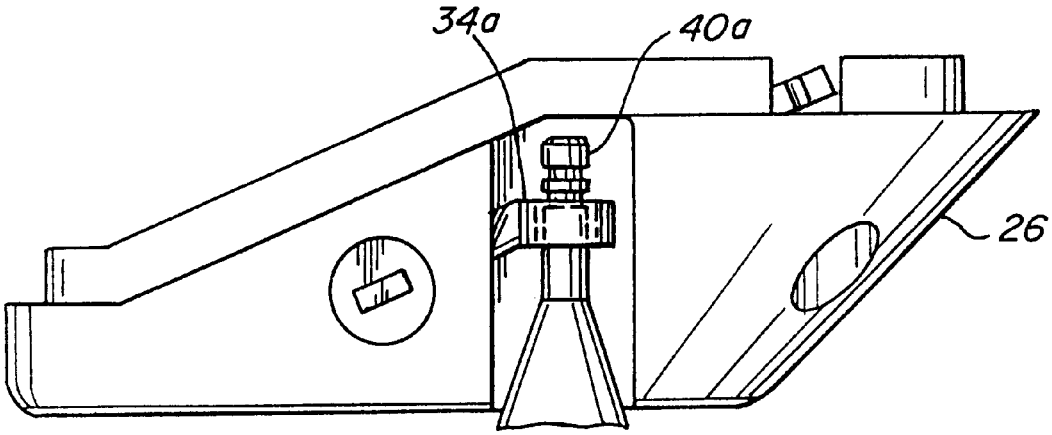
FIG. 12*b* is a right side view of the binding engagement assembly of FIG. 10, in position for release.

As illustrated in FIG. 10, plate members 34*a*, 34*b* may also be supported on either end of axle 49, the plate members being disposed at the pre-selected angle relative to the axle. Axle 49 extends from a first end 49*a* through housing 26 to a second end 49*b* and rotates about axis "x". As shown in FIGS. 11 and 12, first end 49*a* extends through opening 33*a* in corresponding plate member 34*a*, while second end 49*b* extends through opening 33*b* in corresponding plate member 34*b*. Opening 33*a* may preferably be sized larger than first end 49*a* to allow some play, or slop, between plate member 34*a* and engagement of axle 49. In this manner, plate member 34*a* is allowed an amount of initial movement (as represented by arrow "y"), prior to engaging axle 49. Upon engagement of plate member 34*a* with first end 49*a*, the axle is caused to rotate which, in turn, results in corresponding movement of plate member 34*b*. The amount of play between plate member 34*a* and axle 49 is dependent upon the size of the opening 33*a* relative to the axle and can vary, as will be apparent to those of skill in the art. Opening 33*b* need only be sized to fit second end 49*b* therethrough, and need not include room for play, or slop, between the plate member 34*b* and engagement of axle 49 since movement of plate member 34*b* will not cause initial movement of plate member 34*a*. Movement of plate member 34*b* will not cause movement of plate member 34*a* until the first end 49*a* of the axle has sufficiently moved within opening 33*a* so that the slop is overcome, at which point the first end 49*a* will engage plate member 34*a* and cause corresponding movement thereof. In this manner, upon the rider shifting weight from one side of the boot to the other, the boot will remain securely fastened to the binding by allowing the plate member corresponding to the side of the boot receiving additional weight or pressure to move, without resulting in movement of the opposing plate member through an initial range of motion. It should be understood that either opening may be sized to include slop and, if desired, both openings may be so sized, thereby allowing for a greater range of motion before engagement and movement of the opposing plate member. In addition, although a particular shaped opening (i.e., butterfly shape) is illustrated, other opening shapes are contemplated. Plate members 34*a, b* may be formed of a hardened steel and may include a twist 35 in the body portion or may alternatively be formed of any suitable material and may have a variety of shapes. Coil springs 41*a, b* may engage one end of corresponding plate members 34*a, b* in order to bias and maintain the plate members during use, so as to provide the aforementioned necessary frictional engagement.

Figure 2:
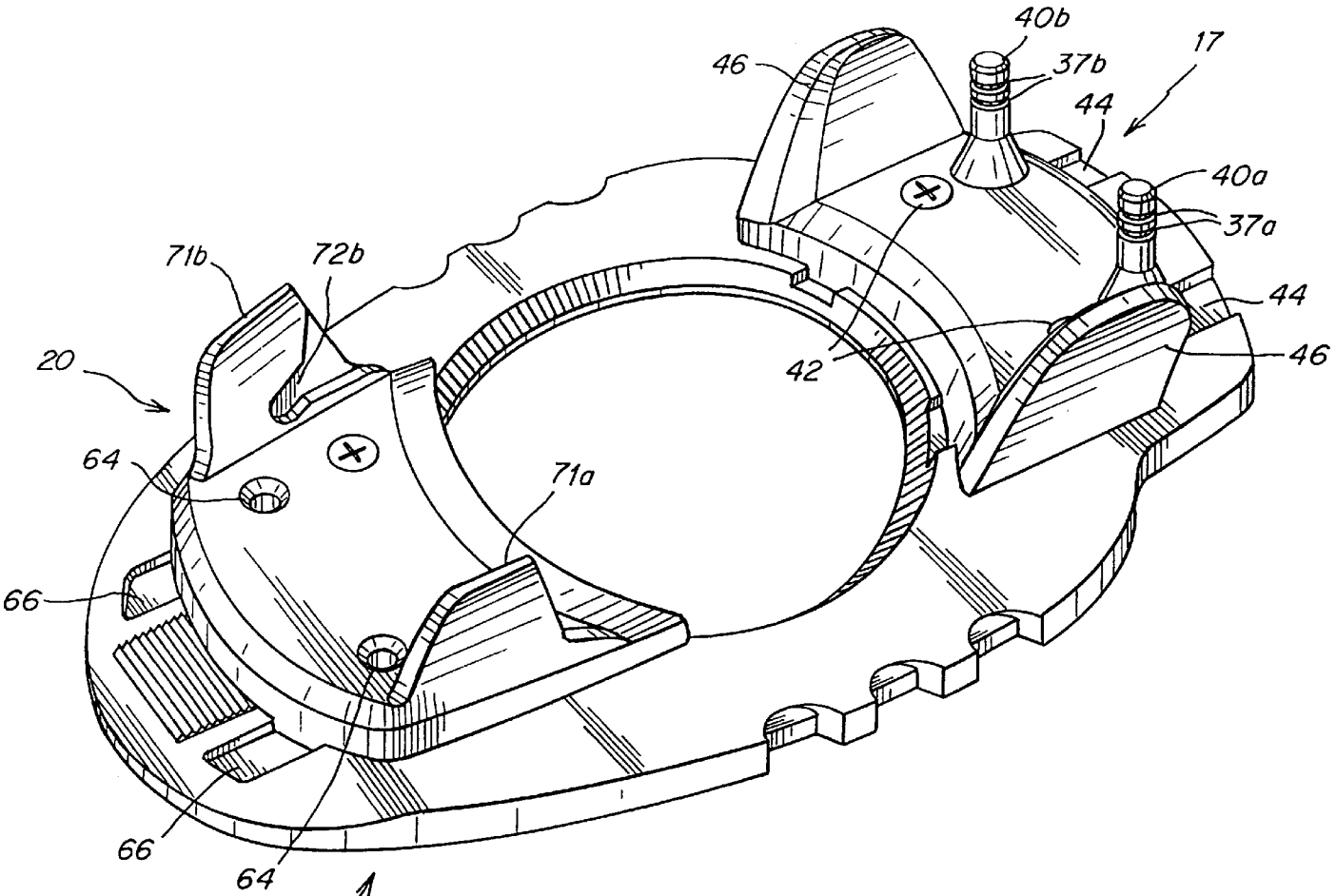
FIG. 2 is a perspective view of one embodiment of a binding of the system of FIG. 1.

Referring now to FIG. 2, locking component 17 preferably includes at least one mounting hole 42 for attaching the locking component 17 to the binding 18. The mounting hole 42 is configured to receive a fastener, for example a screw, and may be positioned to engage rearward tracks 44 disposed in mounting portion 24 so as to allow for lengthwise adjustment of the locking component 17 with respect a second locking component 20, depending upon the size of boot 12. Posts 40*a, b* may be substantially upstanding so as to extend perpendicularly from binding 18, and are positioned so as to be received within the engagement assembly in the second position. As described above, the binding engagement assembly 15 may be disposed anywhere on boot 12, therefore posts 40*a, b* maybe disposed anywhere along binding 18, for example, along the longitudinal axis. In the present embodiment, the binding engagement assembly is positioned in heel portion 13 of the boot, therefore posts 40*a, b* are likewise disposed in the heel engagement portion of binding 18. The posts may be mounted between guide walls 46, and may each include a frustoconical base with a reduced diameter cylindrical portion extending therefrom, although other shapes may also be utilized. Guide walls 46 help direct the user in placement of heel member 14 of the boot over posts 40*a, b* so that the binding engagement assembly 15 is properly aligned with the posts. Posts 40*a, b* may also include grooves 37*a, b* on the top portion thereof which provide an audible clicking sound when the engagement assembly passes over the posts. Any number of posts as well as various post shapes and sizes may be utilized, however, as previously stated, the number, shape and size of the posts should correspond to the configuration of binding engagement assembly 15 for mating engagement therewith. In the present embodiment two posts are utilized which allows the boot to be securely fastened to the binding, even during flex of the boot when riding, which may operate to loosen the interface of one of the posts with the locking component, but preferably not both.

To release boot 12 from engagement with binding 18, the plate members 34*a, b* are moved from the second position (FIG. 3*b*) into a position where apertures 38*a, b* are substantially level (FIG. 3*a*), thereby releasing the plate members from engagement with posts 40*a*, 40*b* as described above. Although the angle of the aperture is adjusted in the illustrated embodiment by movement of the plate member, it should be understood that the apertures may be bored at an angle without angling the plate members, likewise the posts may be angled, and that any combination of angles and movement may be utilized in order to adjust the relative angle between the engagement assembly and locking components. In the present embodiment, a release mechanism 48 including a cable 52 operatively connected to at least one plate member may be utilized, such that pulling on the cable operates to move the plate members in an upward direction, toward the rider, thereby changing the orientation of the apertures relative to the plate members.

Figure 4B:
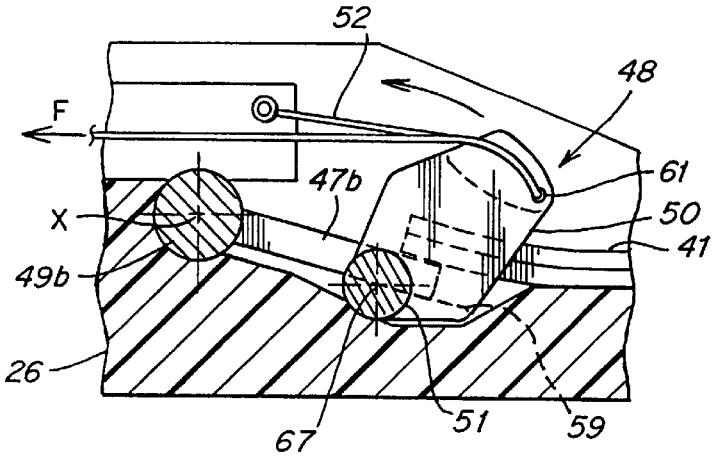
FIG. 4*b* is a schematic of an alternate embodiment of a cable attachment for the binding engagement assembly of FIG. 4*a;*
Figure 5:
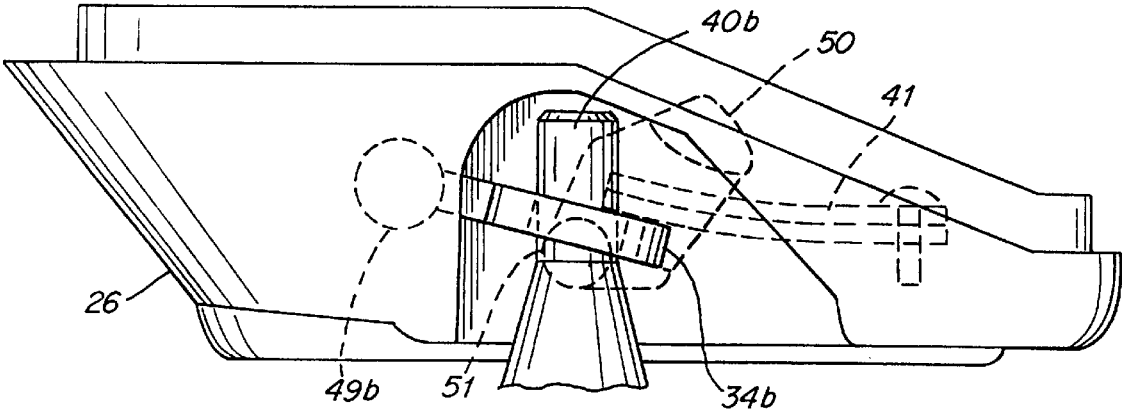
FIG. 5 is a side view of the binding engagement assembly of FIG. 4*a* engaged with a corresponding post.
Figure 6:
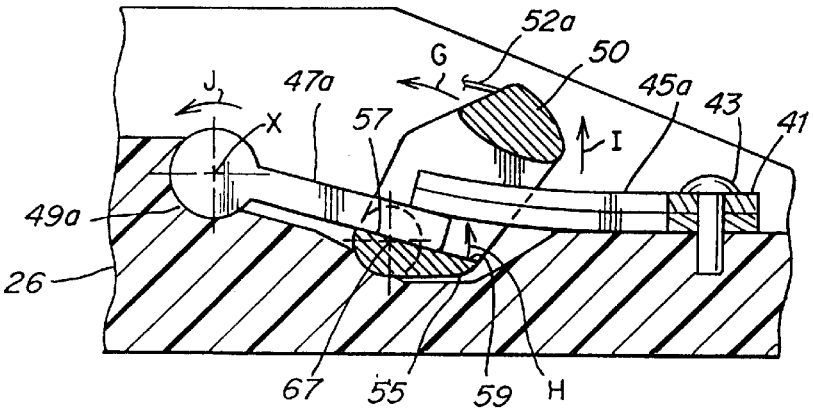
FIG. 6 is a schematic of the release mechanism for the binding engagement assembly of FIG. 4*a;*

For the embodiment illustrated in FIGS. 4–6, the release mechanism 48 preferably includes a cable 52*a, b* which may be fixed to opposite sides of a first end of release element 50. The cable extends from within housing 26, preferably through boot 12 to a point above the upper portion of the boot where it terminates in handle 53 (FIG 1). Release element 50 may be a generally "U" shaped, unitary member having a second end pivotally connected within housing 26 by an axle 51, the axle preferably being disposed below lever arms 47*a, b*. Axle 51 preferably includes a non-symmetrical outer surface 55 such that one portion 57 of the surface contacts the underside of lever arms 47*a, b*, in a first, at rest position, while a second portion 59 of the outer surface is configured to act as a cam which engages the underside of the lever arms in a second, actuated position. Release element 50, and hence axle 51, are actuated by pulling on cables 52*a, b* in the direction of arrow "F" so that the first end of the release element is rotated in the direction indicated by arrow "G", thereby causing corresponding rotation of axle 51 about its axis in the direction of arrow "H". Rotation of axle 51 causes the caming surface 59 to engage the underside of lever arms 47*a, b*, which creates a force against the lever arms (FIG. 6). When this force exceeds the biasing force created by the leaf spring, the lever arm is free to move upward, in the direction indicated by arrow "I". Movement of lever arms 47*a, b* in the direction of arrow "I" causes rotation of each axle 49*a, b*, about axis "x", in the direction of arrow "J", which in turn causes corresponding movement of plate members 34*a, b*, also in an upward direction, "I". The plate members continue to move upward until the plate members and corresponding apertures are substantially level. Once level, the clamping force is released and the plate members may be readily disengaged from posts 40*a*, 40*b*, as previously described.

The cable 52 may alternately be fixed at one end within housing 26, extend through an aperture 61 disposed in release element 50 (FIG. 4*b*), and out through housing 26. Operation of the release mechanism 48 is substantially as described, except that the cable, when pulled in the direction of arrow "F", will slide through aperture 61 and act as a pulley to pivot release element 50 about pivot point 67.

Figure 8:
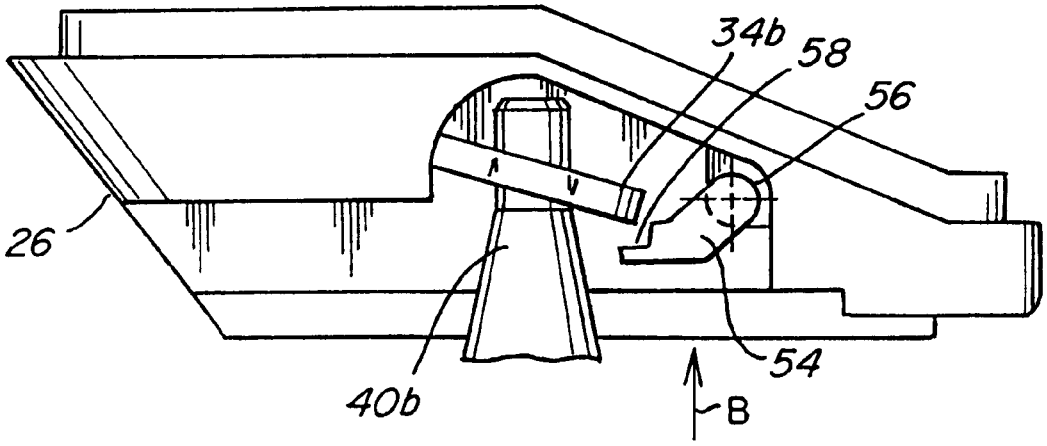
FIG. 8 is a side view of the binding engagement assembly of FIG. 7 engaged with a corresponding post.
Figure 9:
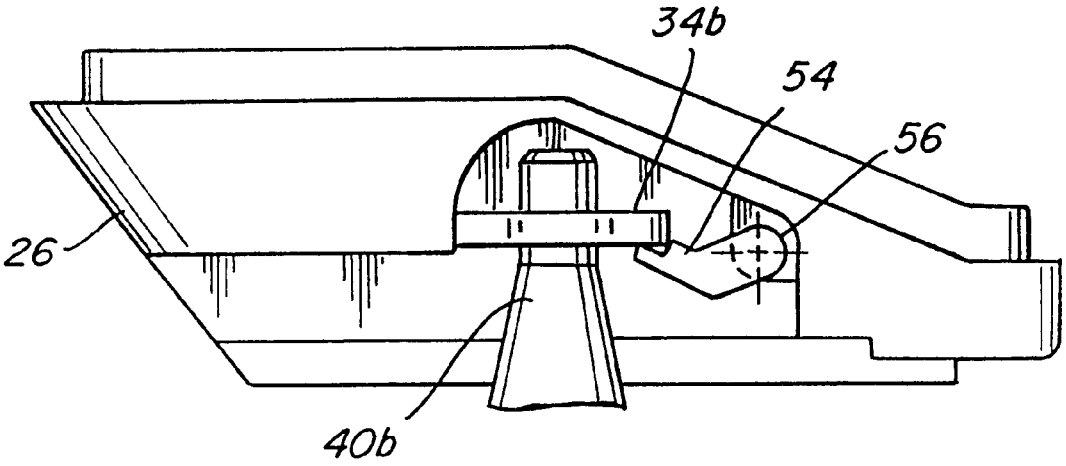
FIG. 9 is a side view of the binding engagement assembly of FIG. 7 during release.

In the embodiment of FIGS. 7–9, release mechanism 48 likewise includes a cable 52*a, b* attached on opposite sides of a first end of release element 50, the cable extending from within housing 26, through boot 12 and terminating in handle 53. Release element 50 may be a generally "H" shaped, unitary member having an engagement lever 54 supported at a second end thereof, the engagement lever 54 extending from opposite sides of housing 26 and into recesses 36*a, b*. As shown in FIG. 8, the engagement lever preferably extends below plate members 34*a, b*, such that the engagement lever does not normally contact the plate members. Engagement lever 54 may be pivotally connected to housing 26 by a pivot pin 56, such that actuation of cables 52*a, b* moves the first end of the release element in the direction of arrow "A" which results in corresponding movement of the engagement lever about the pivot pin, in an upward direction as represented by arrow "B". Engagement lever 54 continues to pivot upward until the engagement lever contacts the plate members and forces the plate members upward, also in the direction of arrow "B". When the plate members and corresponding apertures become substantially level (FIG. 9), the clamping force is released and the plate members may be readily disengaged from posts 40*a*, 40*b*, as previously described. The engagement lever 54 may additionally include a stepped portion 57 which contacts the plate members 34*a, b*, or the engagement lever may have a non-stepped construction. In the present embodiment, the length of the engagement lever 54, as measured from the pivot pin 56 to the end of the stepped portion, is approximately 15 mm. Other lengths may be utilized, provided that the engagement lever is not too long so as to inadvertently contact and release the plate member during use.

In the embodiments of FIGS. 10–12*b*, release mechanism 48 preferably includes a cable 52, which may be attached on either side of release element 50. The cable extends from within housing 26, preferably through boot 12 to a point above the upper portion of the boot where it terminates in handle 53 (FIG 1). Cable may be disposed through either notch 68*a* or 68*b*, depending upon whether the handle is on the right or left side of the boot, respectively. Release element 50 is preferably disposed between plate members 34*a, b* and is connected at one end to axle 49 such that rotation of element 50 causes corresponding rotation of axle 49. To release the binding engagement assembly 15 from engagement with co-operating locking component 17 (FIG. 12*a*), a user pulls on cable 52, moving the cable in the direction indicated by arrow "L" which, in turn, causes release element 50 to rotate in the direction indicated by arrow "M". Rotation of the release element in the direction of arrow "M" causes corresponding rotation of axle 49 about axis "x" which results in movement of the plate members 34*a, b* upward, in the direction of arrow "M". When the plate members and corresponding apertures become substantially level (FIG. 12*b*), the clamping force is released and the plate members may be readily disengaged from posts 40*a*, 40*b*, as previously described.

Figure 17:
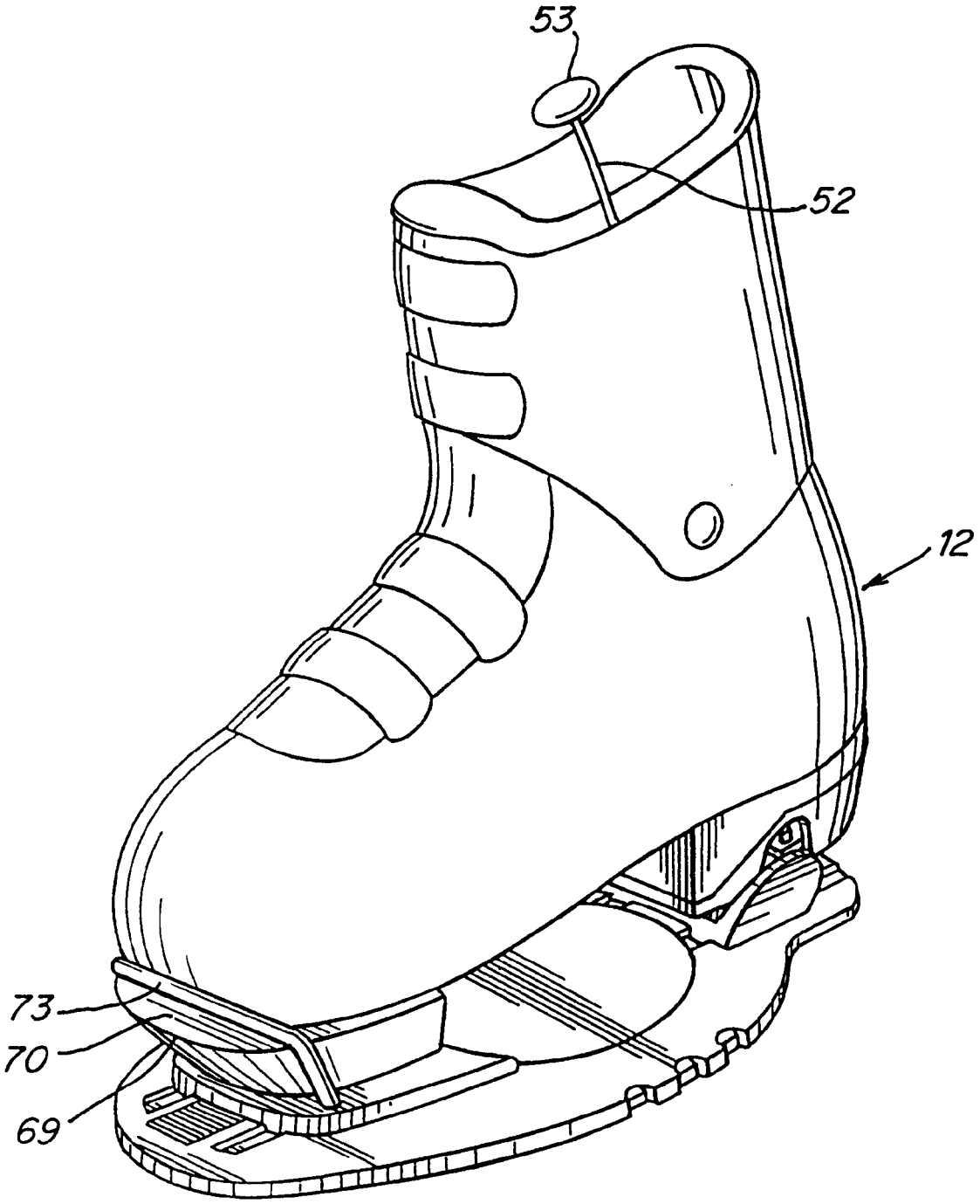
FIG. 17 is perspective view of the system of FIG. 1 including a first binding engagement assembly and a toe bail in an engaged position.

Referring again to FIG. 1, binding system 10 may also include a second engagement assembly 60 for securing at least a portion of boot 12 to binding 18. Engagement assembly 60 may extend from opposite sides of toe section 16, or may alternatively be disposed anywhere along boot 12. Engagement assembly 60 may be configured as a pair of hook-shaped projections 62*a*, 62*b* including a body portion 63 and an engagement portion 65, for mating engagement with binding 18. The engagement assembly 60 may be formed as a unitary member with boot 12 or, as shown in FIG. 14, may be mounted to a ledge 69. Ledge 69 may be mounted so that the front portion of the ledge is in a retracted position and does not extend beyond the front of boot 12 (FIG. 16) or, alternately, may be mounted in an extended position so that the front of the ledge extends forward of the boot, thereby forming a lip 70. Lip 70 may be utilized as an engagement member with a conventional bail (FIG. 17), either alone, or in combination with second engagement assembly 60. The sole 25 is preferably provided with two sets of mounting holes (not shown) adjacent the toe portion which are engaged by fasteners disposed through ledge 69, so that the ledge 69 may be moved between the flush position and the extended position which forms lip 31 so as to provide the user with the ability to use boot 12 with or without conventional bails. In the present embodiment projections 62*a*, 62*b* extend in a downward direction from the toe section, to a distance below the sole 25 of boot 12. Alternatively, the projections may extend outward, from the sides of boot 12, as shown in FIG. 13. Engagement assembly 60 preferably engages a second co-operating locking component 20 supported by binding 18.

As illustrated in FIG. 2, locking component 20 is supported by binding 18 and preferably includes at least one mounting hole 64 for attachment to the binding. The mounting hole 64 is configured to receive a fastener, for example a screw, and may be positioned to engage forward tracks 66 disposed in binding 18. Tracks 66 allow for lengthwise adjustment of the second locking component 20 with respect to the first locking component 17, depending upon the size of boot 12. Locking component 20 may include a pair of side extensions 30*a, b* projecting therefrom, each side extension having a slot 32*a, b* formed therein, the slots being configured for mating engagement with projections 62*a, b*. Side extensions 30*a, b* help direct the user in placement of projections 62*a, b* within slots 32*a, b*. In the present embodiment side extensions 30*a, b* may be slightly outwardly flared as shown in FIG. 2.

Figure 15:
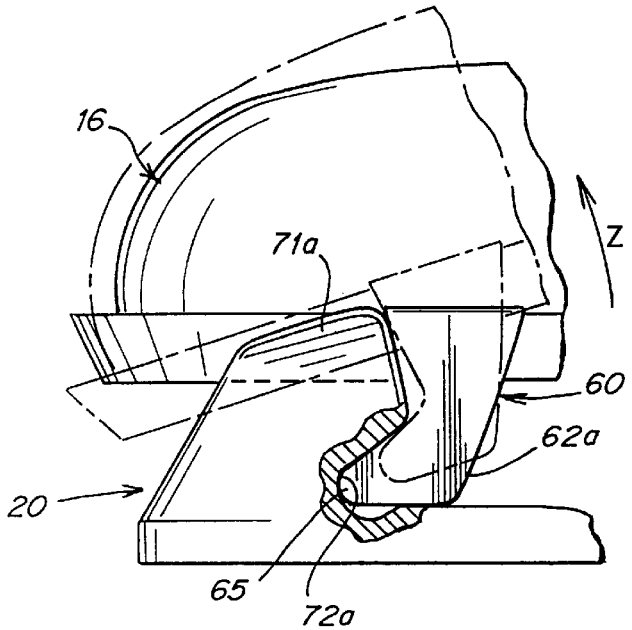
FIG. 15 is a schematic of release of the binding engagement assembly of FIG. 14.

In use, the rider naturally steps into the binding, i.e. with her toe angled downward relative to her heel, and slides projections 62*a, b* into corresponding slots 32*a, b*. When toe section 16 is inserted into the second locking component 20, the angled apertures are also preferably aligned with their corresponding posts. Once the posts and apertures are aligned, the rider simply steps down with her heel, thereby locking the toe section in place (FIG. 16) and forcing the posts to be received within their corresponding apertures. The system is self-locking because the friction created between the posts and the plate members surrounding the apertures is sufficient to secure and maintain the boot relative to the binding. To release the boot 12 from engagement with binding 18, the user pulls on cable 52 which operates to move the plate member in an upward direction, toward the rider, thereby increasing the size of the aperture relative to their corresponding posts until the plate member can easily slide over the posts as the rider lifts her heel from engagement with the binding. To remove the toe section from engagement with the second locking component, the user rotates boot 12 in the direction of arrow "Z" (FIG. 15), the side of the boot riding along the top of the side extensions and forcing the toe portion from engagement with the second locking component. In the present embodiment, as the user disengages and lifts the heel member 14 the toe section begins to rotate, allowing the user to step out of the binding in one motion.

As shown in FIG. 16, the first and second locking components may be utilized in combination to secure boot 12 to binding 18. Alternately, the first and second locking components may be utilized alone, or may be utilized in combination with another locking component, for example bail 66, FIG. 17.

It will be understood that various modifications may be made to the embodiments disclosed herein. For example, the locking component may be supported by the snowboard boot instead of the binding and, likewise, the engagement assembly may be supported by the binding instead of the snowboard boot. The dimensions and location of the binding system may also be readily altered by one of skill in the art. In addition, the binding system may be utilized with any boot and fastener combination, and is not limited to the sport of snowboarding. The cable may, additionally be connected directly to the plate members and the plate members may be actuated together, or independently. The cable may also terminate in a lever mounted to the boot, or in any alternate member, other than a handle. Therefore, the above description should not be construed as limiting, but merely as exemplifications of a preferred embodiment. Those skilled in the art will envision other modifications within the scope spirit of the invention.

What is claimed is:

1. A system for mounting a boot to an article for gliding on snow, comprising:

a binding configured and arranged to be attached to the article for gliding on snow; and a boot configured to be supported by said binding;

one of said binding and said boot including a locking component, the other of said binding and said boot including a binding engagement assembly having at least one integral plate member with an aperture formed therethrough, said aperture having a diameter sufficient to receive a portion of said locking component;

wherein said at least one integral member and said locking component are constructed and arranged for relative movement therebetween so as to vary the relative size of said aperture to said locking component between a first relative size where said locking component is moveable within said aperture, and a second relative size where said locking component is no longer moveable within said aperture such that said locking component is secured to said member.

2. A system for mounting a boot to an article for gliding on snow, comprising:

a binding configured and arranged to be attached to the article for gliding on snow; and a boot configured to be supported by said binding;

one of said binding and said boot including a locking component, the other of said binding and said boot including a binding engagement assembly having at least one member with an aperture formed therethrough, said aperture having a diameter sufficient to receive a portion of said locking component;

wherein said at least one member is pivotally supported relative to said locking component so as to vary the relative size of said aperture to said locking component between a first relative size where said locking component is moveable within said aperture, and a second relative size where said locking component is no longer moveable within said aperture such that said locking component is secured to said member.

3. A system for mounting a boot to an article for gliding on snow, comprising:

a binding configured and arranged to be attached to the article for gliding on snow; and a boot configured to be supported by said binding;

one of said binding and said boot including a locking component, the other of said binding and said boot including a binding engagement assembly that is selectively releasable from said locking component, said binding engagement assembly having at least one member with an aperture formed therethrough, said aperture having a diameter sufficient to receive a portion of said locking component;

wherein said at least one member and said locking component are constructed and arranged for relative movement therebetween so as to vary the relative size of said aperture to said locking component between a first relative size where said locking component is moveable within said aperture, and a second relative size where said locking component is no longer moveable within said aperture such that said locking component is secured to said member with a binding force, said binding force being increasable by decreasing the relative size of said aperture to said locking component from the second relative size to a third relative size;

wherein said binding engagement assembly further includes an axle to support said at least one member, said axle having a first end and a second end, wherein said at least one member includes a first member and a second member, and wherein said second end extends through an opening in said second member, said opening being sized to closely match the shape of said second end so that said second member and said second end do not move independently.

4. A system for mounting a boot to an article for gliding on snow, comprising:

a binding configured and arranged to be attached to the article for gliding on snow;

a boot configured to be supported by said binding;

one of said binding and said boot including a locking component, the other of said binding and said boot including a binding engagement assembly that is selectively releasable from said locking component, said binding engagement assembly having at least one member with an aperture formed therethrough, said aperture having a diameter sufficient to receive a portion of said locking component, wherein said binding engagement assembly further includes an axle to support said at least one member, said axle having a first end and a second end;

wherein said at least one member and said locking component are constructed and arranged for relative movement therebetween so as to vary the relative size of said aperture to said locking component between a first relative size where said locking component is moveable within said aperture, and a second relative size where said locking component is no longer moveable within said aperture such that said locking component is secured to said member with a binding force, said binding force being increasable by decreasing the relative size of said aperture to said locking component from the second relative size to a third relative size; and a release mechanism having a release lever operatively connected to said axle such that actuation of said release lever causes rotation of said axle, which results in movement of said at least one member to adjust the relative size of said aperture toward said first relative size.

5. A system for mounting a boot to an article for gliding on snow, comprising:

a binding configured and arranged to be attached to the article for gliding on snow;

a boot configured to be supported by said binding; and a release mechanism operatively associated with said binding engagement assembly, one of said binding and said boot including a locking component, the other of said binding and said boot including a binding engagement assembly having at least one member with an aperture formed therethrough, said aperture having a diameter sufficient to receive a portion of said locking component;

wherein said at least one member and said locking component are constructed and arranged for relative movement therebetween so as to vary the relative size of said aperture to said locking component between a first relative size where said locking component is moveable within said aperture, and a second relative size where said locking component is no longer moveable within said aperture such that said locking component is secured to said member, and actuation of said release mechanism adjusts the relative size of said aperture toward said first relative size.

6. The system according to claim 5, wherein said release mechanism includes a pivotable engagement lever, wherein pivoting said engagement lever into contact with said at least one member moves said at least one member to adjust the relative size of said aperture toward said first relative size to allow said locking component to be withdrawn from said aperture.

7. A system for mounting a boot to an article for gliding on snow, comprising:

a binding configured and arranged to be attached to the article for gliding on snow, the binding including a locking component; and a boot configured to be supported by said binding, the boot including a binding engagement assembly having at least one member with an aperture formed therethrough, said aperture having a diameter sufficient to receive a portion of said locking component;

wherein said at least one member and said locking component are constructed and arranged for relative movement therebetween so as to vary the relative size of said aperture to said locking component between a first relative size where said locking component is moveable within said aperture, and a second relative size where said locking component is no longer moveable within said aperture such that said locking component is secured to said member, said aperture being disposed at an angle relative to a horizontal plane defined by a sole of said boot to establish said second relative size.

8. The system according to claim 7, wherein the angle is in the range of approximately 3 to 30 degrees relative to the horizontal plane.

9. The system according to claim 7, wherein the angle is in the range of approximately 5 to 15 degrees.

10. The system according to claim 7, wherein the angle is approximately 6 degrees.

11. A system for mounting a boot to an article for gliding on snow, comprising:

a binding configured and arranged to be attached to the article for gliding on snow; and a boot configured to be supported by said binding;

one of said binding and said boot including a locking component, the other of said binding and said boot including a binding engagement assembly that is selectively releasable from said locking component, said binding engagement assembly having at least one member with an aperture formed therethrough, said aperture having a diameter sufficient to receive a portion of said locking component;

wherein said at least one member and said locking component are constructed and arranged for relative movement therebetween so as to vary the relative size of said aperture to said locking component between a first relative size where said locking component is moveable within said aperture, and a second relative size where said locking component is no longer moveable within said aperture such that said locking component is secured to said member with a binding force, said binding force being increasable by decreasing the relative size of said aperture to said locking component from the second relative size to a third relative size;

wherein said binding engagement assembly is disposed on said boot and said locking component is disposed on said binding;

wherein said binding engagement assembly is at least partially disposed within a housing supported by said boot;

wherein said housing is removably mounted to said boot; and wherein said housing is moveable between an extended position to form a first engagement member extending from said boot and a retracted position for reducing the profile of said boot.

12. The system according to claim 11, wherein said first engagement member is engageable with a bail.

13. The system according to claim 11, wherein said boot includes a sole having a plurality of mounting holes engageable by fasteners disposed through said housing, said plurality of mounting holes including at least one first mounting hole to mount said housing in the retracted position and at least one second mounting hole to mount said housing in the extended position.

14. A system for mounting a boot to an article for gliding on snow, comprising:

a binding configured and arranged to be attached to the article for gliding on snow; and a boot configured to be supported by said binding;

one of said binding and said boot including a locking component, the other of said binding and said boot including a binding engagement assembly that is selectively releasable from said locking component, said binding engagement assembly having at least one member with an aperture formed therethrough, said aperture having a diameter sufficient to receive a portion of said locking component;

wherein said at least one member and said locking component are constructed and arranged for relative movement therebetween so as to vary the relative size of said aperture to said locking component between a first relative size where said locking component is moveable within said aperture, and a second relative size where said locking component is no longer moveable within said aperture such that said locking component is secured to said member with a binding force, said binding force being increasable by decreasing the relative size of said aperture to said locking component from the second relative size to a third relative size;

wherein said binding engagement assembly is disposed on said boot and said locking component is disposed on said binding;

wherein said binding includes a second engagement component and said boot includes a second binding engagement member configured and arranged to engage said second engagement component; and wherein said second binding engagement member is mounted to a ledge, said ledge being removably mountable to said boot.

15. The system according to claim 14, wherein said ledge is moveable between an extended position to form a second engagement member extending from said boot and a retracted position for reducing the profile of said boot.

16. The system according to claim 15, wherein said boot includes a sole having a plurality of mounting holes so that said ledge can be moved between the retracted position and the extended position.

17. A boot for use with an article for gliding on snow including a binding having a locking component, the boot comprising:

a boot body including a toe portion and a heel portion;

a binding engagement assembly supported by said boot body and having at least one member with an aperture extending therethrough, said aperture having a diameter sufficient to receive a portion of the locking component; and a release mechanism operatively associated with said binding engagement assembly, wherein said at least one member and the locking component are constructed and arranged for relative movement therebetween so as to vary the relative size of said aperture to the locking component between a first relative size where the locking component is moveable within said aperture, and a second relative size where the locking component is no longer moveable within said aperture such that the locking component is secured to said at least one member, and actuation of said release mechanism moves said at least one member to adjust the relative size of said aperture toward said first relative size.

18. A boot for use with an article for gliding on snow including a binding having a locking component, the boot comprising:

a boot body including a toe portion and a heel portion; and a binding engagement assembly supported by said boot body and having at least one integral plate member with an aperture extending therethrough, said aperture having a diameter sufficient to receive a portion of the locking component;

wherein said at least one integral member and the locking component are constructed and arranged for relative movement therebetween so as to vary the relative size of said aperture to the locking component between a first relative size where the locking component is moveable within said aperture, and a second relative size where the locking component is no longer moveable within said aperture such that the locking component is secured to said at least one member.

19. The boot according to claim 18, wherein said at least one plate member includes a plurality of stacked plate members.

20. A boot for use with an article for gliding on snow including a binding having a locking component, the boot comprising:

a boot body including a toe portion and a heel portion; and a binding engagement assembly supported by said boot body and having at least one member with an aperture extending therethrough, said aperture having a diameter sufficient to receive a portion of the locking component;

wherein said at least one member is pivotally supported by said boot body such that said at least one member is pivotable relative to the locking component so as to vary the relative size of said aperture to the locking component between a first relative size where the locking component is moveable within said aperture, and a second relative size where the locking component is no longer moveable within said aperture such that the locking component is secured to said at least one member.

21. A boot for use with an article for gliding on snow including a binding having a locking component, the boot comprising:

a boot body including a toe portion and a heel portion; and a binding engagement assembly supported by said boot body that is selectively releasable from the locking component, said binding engagement assembly having at least one member with an aperture extending therethrough, said aperture having a diameter sufficient to receive a portion of the locking component;

wherein said at least one member and the locking component are constructed and arranged for relative movement therebetween so as to vary the relative size of said aperture to the locking component between a first relative size where the locking component is moveable within said aperture, and a second relative size where the locking component is no longer moveable within said aperture such that the locking component is secured to said at least one member with a binding force, said binding force being increasable by decreasing the relative size of said aperture to said locking component from the second relative size to a third relative size;

wherein said binding engagement assembly further includes an axle to support said at least one member, said axle having a first end and a second end;

wherein said at least one member includes a first member and a second member; and wherein said second end extends through an opening in said second member, said opening being sized to closely match the shape of said second end so that said second member and said second end do not move independently.

22. A boot for use with an article for gliding on snow including a binding having a locking component, the boot comprising:

a boot body including a toe portion and a heel portion;

a binding engagement assembly supported by said boot body that is selectively releasable from the locking component, said binding engagement assembly having at least one member with an aperture extending therethrough, said aperture having a diameter sufficient to receive a portion of the locking component, wherein said binding engagement assembly further includes an axle to support said at least one member, said axle having a first end and a second end;

wherein said at least one member and the locking component are constructed and arranged for relative movement therebetween so as to vary the relative size of said aperture to the locking component between a first relative size where the locking component is moveable within said aperture, and a second relative size where the locking component is no longer moveable within said aperture such that the locking component is secured to said at least one member with a binding force, said binding force being increasable by decreasing the relative size of said aperture to said locking component from the second relative size to a third relative size; and a release mechanism having a release lever operatively connected to said axle such that actuation of said release lever causes rotation of said axle, which results in movement of said at least one member to adjust the relative size of said aperture toward said first relative size.

23. A boot for use with an article for gliding on snow including a binding having a locking component, the boot comprising:

a boot body including a toe portion and a heel portion; and a binding engagement assembly supported by said boot body that is selectively releasable from the locking component, said binding engagement assembly having at least one member with an aperture extending therethrough, said aperture having a diameter sufficient to receive a portion of the locking component;

wherein said at least one member and the locking component are constructed and arranged for relative movement therebetween so as to vary the relative size of said aperture to the locking component between a first relative size where the locking component is moveable within said aperture, and a second relative size where the locking component is no longer moveable within said aperture such that the locking component is secured to said at least one member with a binding force, said binding force being increasable by decreasing the relative size of said aperture to said locking component from the second relative size to a third relative size;

wherein said binding engagement assembly is disposed at said heel portion of said boot body;

wherein said binding engagement assembly is at least partially disposed within a housing supported by said boot; and wherein said housing is moveable between an extended position to form a first engagement member extending from said boot body and a retracted position for reducing the profile of said boot.

24. The boot according to claim 23, wherein said first engagement member is engageable with a bail.

25. The boot according to claim 23, wherein said boot body includes a sole having a plurality of mounting holes engageable by fasteners disposed through said housing, said plurality of mounting holes including at least one first mounting hole to mount said housing in the retracted position and at least one second mounting hole to mount said housing in the extended position.

26. A boot for use with an article for gliding on snow including a binding having a locking component, the boot comprising:

a boot body including a toe portion and a heel portion;

a binding engagement assembly supported by said boot body that is selectively releasable from the locking component, said binding engagement assembly having at least one member with an aperture extending therethrough, said aperture having a diameter sufficient to receive a portion of the locking component;

wherein said at least one member and the locking component are constructed and arranged for relative movement therebetween so as to vary the relative size of said aperture to the locking component between a first relative size where the locking component is moveable within said aperture, and a second relative size where the locking component is no longer moveable within said aperture such that the locking component is secured to said at least one member with a binding force, said binding force being increasable by decreasing the relative size of said aperture to said locking component from the second relative size to a third relative size; and a second binding engagement member supported by said boot body to engage a second engagement component supported by the binding;

wherein said second binding engagement member is mounted to a ledge, said ledge being removably mountable to the boot body.

27. The boot according to claim 26, wherein said ledge is moveable between an extended position to form a second engagement member extending from said boot body and a retracted position for reducing the profile of the boot.

28. The boot according to claim 27, wherein said boot body includes a sole having a plurality of mounting holes so that said ledge is movable between the retracted position and the extended position.

29. A binding for securing a boot to an article for gliding, the boot supporting a first binding engagement assembly including at least one member having an aperture extending therethrough, the binding comprising:

a base constructed and arranged to be attached to the article for gliding to support the boot thereon; and a locking component extending from said base, said locking component including a cylindrical portion that is constructed and arranged to be received within the aperture and engaged by the at least one member when the boot is supported on said base, said locking component and the at least one member being designed for relative movement therebetween so as to vary the relative size of the aperture to said locking component between a first relative size where said locking component is moveable within the aperture and a second relative size where the locking component is no longer moveable within the aperture so that said locking component is secured to the first binding engagement assembly.

30. The binding according to claim 25, wherein said locking component includes at least one post dimensioned to be received within the aperture.

31. The binding according to claim 30, wherein said base includes a heel engagement portion upon which the heel section of the boot overlies when the boot is supported on said base, said at least one post being supported in said heel engagement portion.

32. The binding according to claim 30, wherein said at least one post includes a frustoconical base with said cylindrical portion having a reduced diameter extending from said frustoconical base.

33. The binding according to claim 30, wherein said at least one post includes a groove that cooperates with the at least one member to create an audible sound when said at least one post is received within the aperture.

34. The binding according to claim 30, wherein said at least one post is substantially upstanding from the binding.

35. The binding according to claim 29, wherein the boot includes a second binding engagement member and the binding includes a second engagement component constructed and arranged to releasably engage the second binding engagement member.

36. The binding according to claim 35, wherein said second engagement component includes a slot that is adapted to releasably receive the second binding engagement member.

37. The binding according to claim 35, wherein said base includes a toe section upon which the toe section of the boot overlies when the boot is supported on said base, a portion of said second engagement component being located in said toe section of said base.

38. The binding according to claim 35, wherein said second engagement component includes a bail to releasably engage the second binding engagement member.

39. A method for releasably securing a boot to an article for gliding on snow, the method comprising steps of:

providing a binding configured and arranged to be attached to the article for gliding on snow, said binding including a locking component;

providing a boot including a binding engagement assembly having at least one member with an aperture extending at least partially therethrough, said aperture having a diameter sufficient to receive a portion of said locking component therethrough;

providing a release mechanism operatively associated with said at least one member; and actuating said release mechanism to move said at least one member to vary the relative size of said aperture to said locking component between a first relative size where said locking component is moveable within said aperture, and a second relative size where said locking component is no longer moveable within said aperture, such that said locking component is secured to said at least one member.

40. A system for mounting a boot to an article for gliding on snow, comprising:

a binding configured and arranged to be attached to the article for gliding on snow; and a boot configured to be supported by said binding;

one of said binding and said boot including a locking component, the other of said binding and said boot including a binding engagement assembly having at least one member with an aperture formed therethrough, said aperture having a diameter sufficient to receive a portion of said locking component;

wherein said at least one member and said locking component are constructed and arranged for relative movement therebetween so as to vary the relative size of said aperture to said locking component between a first relative size where said locking component is moveable within said aperture, and a second relative size where said locking component is no longer moveable within said aperture such that said locking component is secured to said member, the diameter of said aperture not varying between said first relative size and said second relative size.

* * * * *